US011073351B2

(12) United States Patent
Tai et al.

(10) Patent No.: US 11,073,351 B2
(45) Date of Patent: Jul. 27, 2021

(54) PISTOL DEVICE

(71) Applicants: Chen-Hung Tai, New Taipei (TW); Hwa-Nung Lee, New Taipei (TW); Yo-Lun Chang, New Taipei (TW)

(72) Inventors: Chen-Hung Tai, New Taipei (TW); Hwa-Nung Lee, New Taipei (TW); Yo-Lun Chang, New Taipei (TW)

( * ) Notice: Subject to any disclaimer, the term of this patent is extended or adjusted under 35 U.S.C. 154(b) by 0 days.

(21) Appl. No.: 17/025,627

(22) Filed: Sep. 18, 2020

(65) Prior Publication Data

US 2021/0116194 A1 Apr. 22, 2021

(30) Foreign Application Priority Data

Oct. 17, 2019 (TW) ..... 108137486

(51) Int. Cl.
*F41C 23/10* (2006.01)
*F41A 9/61* (2006.01)

(52) U.S. Cl.
CPC ..... *F41A 9/61* (2013.01); *F41C 23/10* (2013.01)

(58) Field of Classification Search
CPC .... F41A 11/00; F41A 3/66; F41A 9/61; F41A 17/38; F41C 23/10
USPC ..... 42/7, 6, 71.02
See application file for complete search history.

(56) References Cited

U.S. PATENT DOCUMENTS 4,520,585 A * 6/1985 Barrett ..... F41C 23/10 42/7
10,066,885 B2 * 9/2018 Chen ..... F41A 9/59
10,809,025 B2 * 10/2020 Harrigan ..... F41A 5/02
10,859,343 B1 * 12/2020 Glen ..... F41C 23/10
2013/0139426 A1 * 6/2013 Baxley ..... F41C 23/10 42/71.02

FOREIGN PATENT DOCUMENTS

CA 2461321 A1 * 9/2004 ..... F41C 23/10

* cited by examiner

*Primary Examiner* — Reginald S Tillman, Jr.
(74) *Attorney, Agent, or Firm* — Birch, Stewart, Kolasch & Birch, LLP

(57) ABSTRACT

A pistol device includes a handgrip portion having a grip body defining an accommodation space, a snap hole extending through a front side of the grip body, and two positioning holes extending through left and right sides of the grip body. The snap and positioning holes communicate with the accommodation space. A magazine base is detachably disposed on a bottom end of the handgrip portion, and includes a surrounding wall, a snap block detachably engageable with the snap hole, and a connecting portion connected to the surrounding wall and having at least one pin hole extending therethrough. A positioning pin is detachably inserted through the positioning holes and the pin hole to fix the magazine base to the handgrip portion.

9 Claims, 10 Drawing Sheets

PISTOL DEVICE

CROSS-REFERENCE TO RELATED APPLICATION

This application claims priority to Taiwanese Patent Application No. 108137486, filed on Oct. 17, 2019.

FIELD

The disclosure relates to a pistol device.

BACKGROUND

Due to the fact that a pistol has few components and a simple structure, and is durable and reliable, it is often used as a gun for a police or a toy gun for a survival game. Its appearance and interior structure are constantly updated to satisfy the use requirements of different units, the experience of using the gun and the desire of collection of consumers. After using the pistol for a certain number of years, only the frame must be replaced, and the inner components, such as the locking block, the trigger, etc., made by the original manufacturer may still be usable. Thus, some manufacturers will only make plastic frames for the pistols, and the user can remove the inner components from the pistol made by the original manufacturer and install them into the new plastic frame to produce a new pistol with plastic frame.

An existing plastic frame of the pistol usually has its lower side installed with a magazine base to protect a lower end of a magazine. However, the existing magazine base is only screwed to a rear side of a handgrip of the pistol. Apart from the process of assembly and disassembly thereof being inconvenient, the direction of recoil force generated during firing is parallel to the locking direction of the screw, so that it is easy to increase the risk of loosening the screw from the handgrip. Further, the existing plastic frame of the pistol must modify the length of the handgrip thereof to conform with the length of the magazine before it can launch different pistol types for increasing or decreasing its capacity of the bullets. As a result, if the user has different capacity requirements for bullets, it is often necessary to purchase a new frame for the pistol, thereby increasing the user's purchase cost.

SUMMARY

Therefore, an object of the present disclosure is to provide a pistol device that is capable of alleviating at least one of the drawbacks of the prior art.

Accordingly, a pistol device of this disclosure includes a frame, a magazine base and a positioning pin. The frame is made of plastic, and includes a handgrip portion which has a grip body defining an accommodation space, a snap hole extending through a front side of the grip body and communicating with the accommodation space, and two positioning holes respectively extending through left and right sides of the grip body in proximity to a rear side thereof and communicating with the accommodation space. The accommodation space has an opening that faces downward, and is configured to accommodate a magazine that extends therein through the opening.

The magazine base is detachably disposed on a bottom end of the handgrip portion, and includes a surrounding wall that has a front end portion, a rear end portion and an intermediate portion between the front and rear end portions, a snap block disposed on the surrounding wall and detachably engageable with the snap hole, and a connecting portion connected to the surrounding wall in proximity to the rear end portion and having at least one pin hole that extends therethrough in a left-right direction and that aligns with the positioning holes. The positioning pin is detachably inserted through the positioning holes and the at least one pin hole to fix the magazine base to the handgrip portion.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
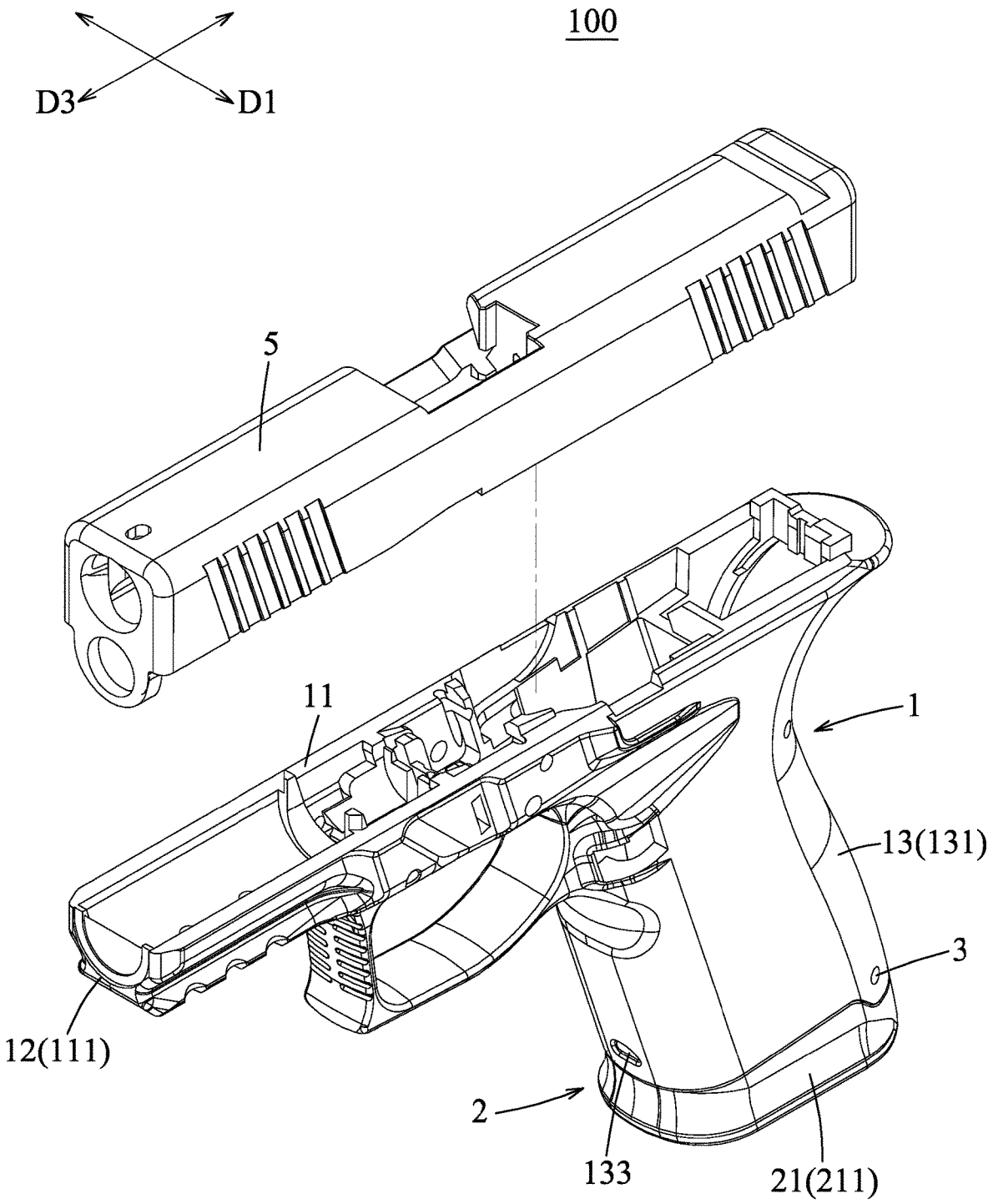
FIG. 1 is a partly exploded perspective view of a pistol device according to the first embodiment of the present disclosure.

Before the present disclosure is described in greater detail, it should be noted herein that like elements are denoted by the same reference numerals throughout the disclosure.

Figure 2:
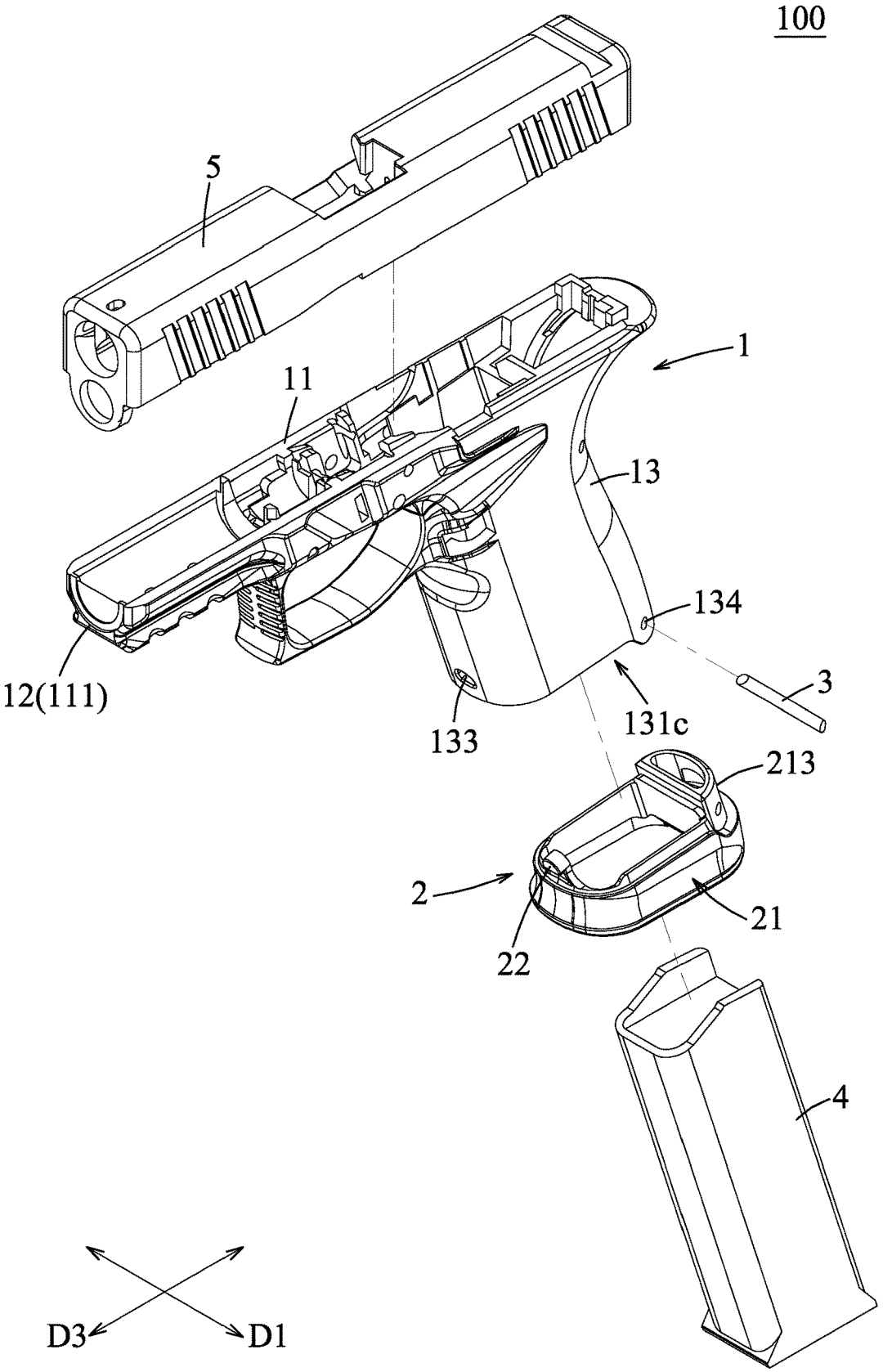
FIG. 2 is an exploded perspective view of the first embodiment, but without a slide.
Figure 3:
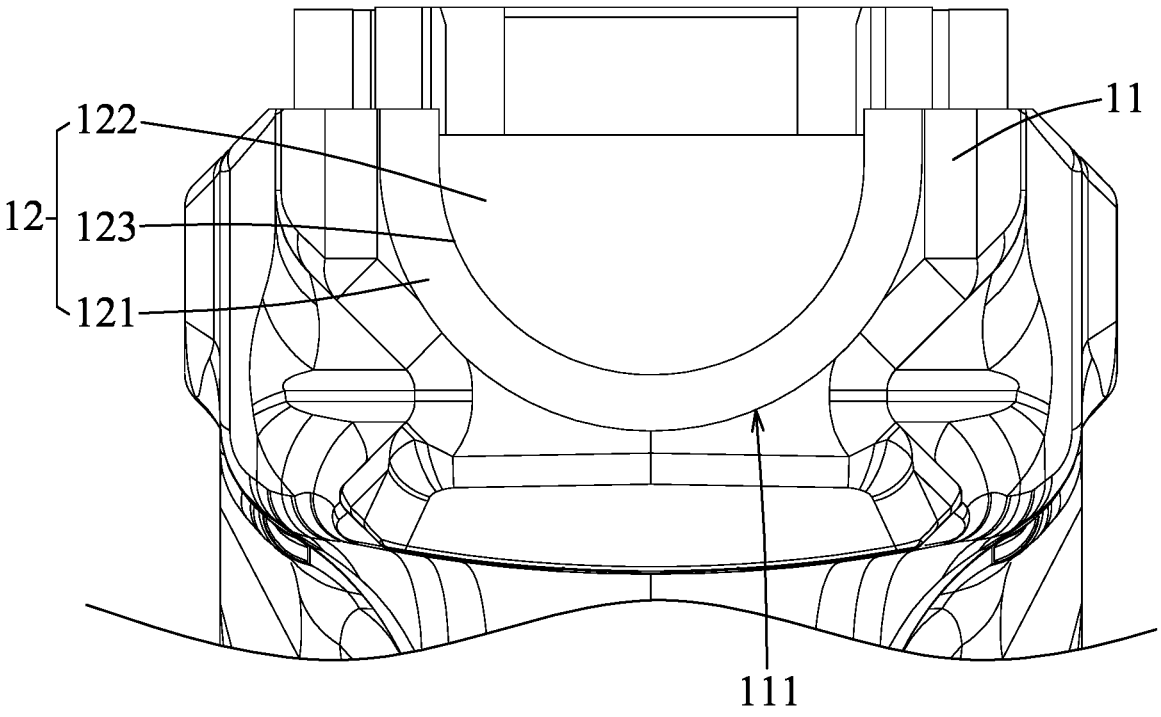
FIG. 3 is a front view of an upper frame portion of the first embodiment.

Referring to FIGS. 1 to 3, a pistol device 100 according to the first embodiment of the present disclosure includes a frame 1, a magazine base 2, a positioning pin 3, and a slide 5.

In this embodiment, the frame 1 is exemplified as a frame of a Glock pistol, but is not limited thereto. The frame 1 is integrally made of plastic in order to lower the manufacturing cost, to reduce the overall weight and to enhance the overall structural strength thereof. The frame 1 includes an upper frame portion 11, a removable plate portion 12 and a handgrip portion 13. The upper frame portion 11 extends along a front-rear direction (D3), and has an end opening 111. The removable plate portion 12 is removably disposed on the end opening 111, and includes a semi-circular U-shaped outer plate portion 121 connected to the upper frame portion 11, and a semi-circular inner plate portion 122 connected to the outer plate portion 121 and having a thickness smaller than that of the outer plate portion 121. A score line 123 is formed at the juncture of the inner plate portion 122 and the outer plate portion 121. A user can push the inner plate portion 122 in the front-rear direction (D3) to remove the inner plate portion 122 from the outer plate portion 121 along the score line 123.

The slide 5 can have any conventional structure, and is assembled to the upper frame portion 11 after the inner plate portion 122 is removed from the outer plate portion 121.

Since there are diverse styles of the slides for different types of pistols, the user can decide whether to remove the outer plate portion 121 or not according to the requirement so as to conform to the slide of a particular type of pistol. As such, the slide of different types of pistols can be assembled to the frame 1.

Figure 4:
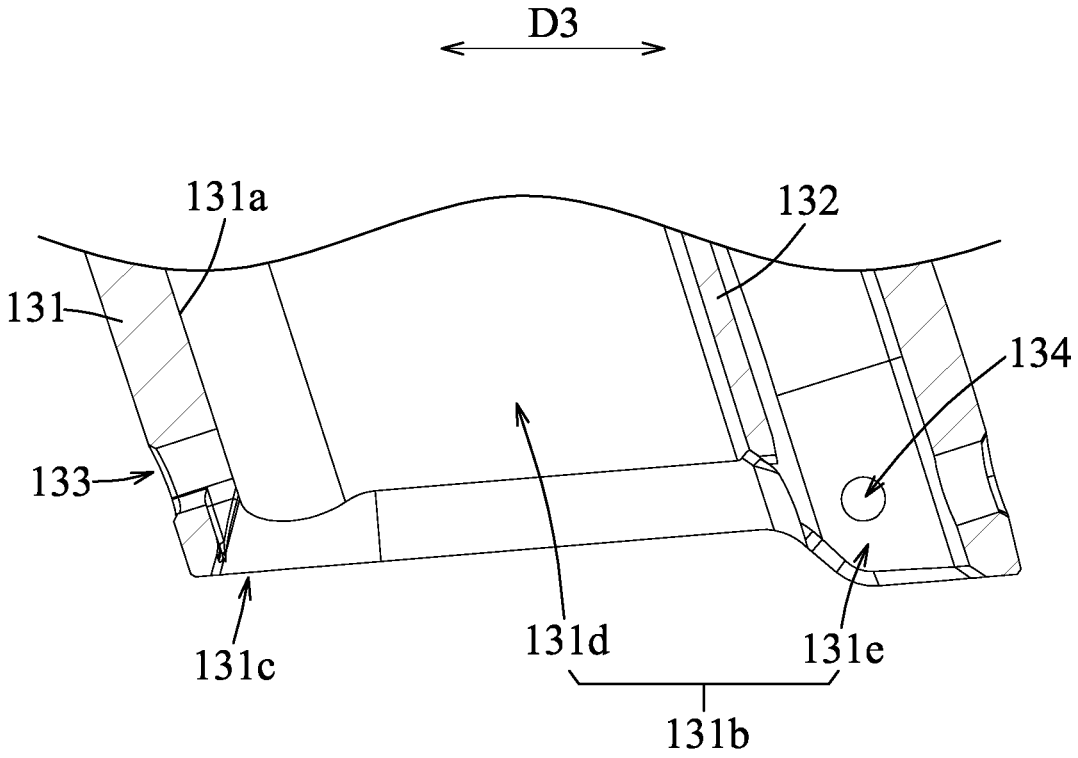
FIG. 4 is a fragmentary sectional view of a handgrip portion of the first embodiment.

Referring to FIG. 4, in combination with FIG. 2, the handgrip portion 13 is connected to the upper frame portion 11, and is distal to the end opening 111 thereof. The handgrip portion 13 has a grip body 131, a partition plate 132, a snap hole 133, and two positioning holes 134 (only one is visible in FIGS. 2 and 4). The grip body 131 has an inner wall surface (131*a*) defining an accommodation space (131*b*). The accommodation space (131*b*) has an opening (131*c*) facing downward. The partition plate 132 is disposed in the accommodation space (131*b*), and has left and right sides connected to the inner wall surface (131*a*) so as to divide the accommodation space (131*b*) into a front space portion (131*d*) and a rear space portion (131*e*). The front space portion (131*d*) is configured to receive a magazine 4 which is inserted therein through the opening (131*c*). The snap hole 133 extends through a front side of the grip body 131, and communicates with the front space portion (131*d*). The positioning holes 134 respectively extend through left and right sides of the grip body 131 in proximity to a rear side thereof, and communicate with the rear space portion (131*e*).

Figure 5:
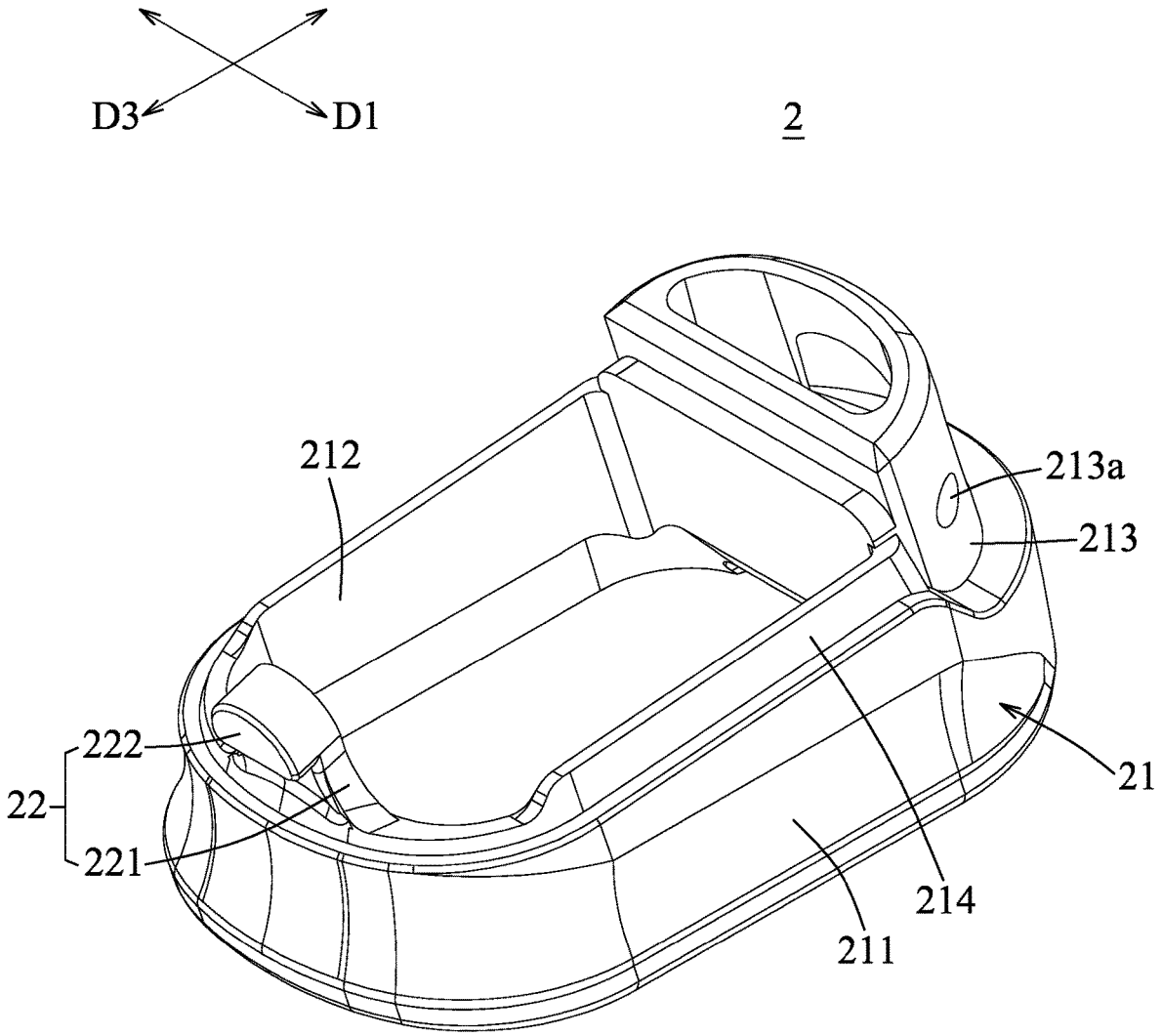
FIG. 5 is a perspective view of a magazine base of the first embodiment.

Referring to FIG. 5, the magazine base 2 is detachably disposed on a bottom end of the handgrip portion 13. In this embodiment, the magazine base 2 includes a surrounding wall 21, a connecting portion 213, an inner connecting flange 214, and a snap block 22. The surrounding wall 21 has a front end portion, a rear end portion, and an intermediate portion between the front and rear end portions. The surrounding wall 21 has a height that gradually increases from the front end portion to the intermediate portion, and then decreases downward to the rear end portion, so that the surrounding wall 21 is slanted from the front end portion to the intermediate portion. When the surrounding wall 21 is assembled to the handgrip portion 13, an outer wall surface 211 of the surrounding wall 21 is flush with an outer wall surface of the grip body 131, as shown in FIG. 1.

In an alternative form of the magazine base 2, the height of the surrounding wall 21 may be adjusted such that when the magazine base 2 is disposed on the bottom end of the handgrip portion 13, a lower end of the front space portion (131*d*) may be extended, so that the length of the front space portion (131*d*) can conform to the different lengths of the magazine 4 so as to prevent the bottom end of the magazine 4 from extending out of and being exposed from the magazine base 2, or prevent the difficult mounting of the magazine 4 into the front space portion (131*d*) when the length of the magazine 4 is short. Furthermore, it can also facilitate holding by a user with large hands, thereby improving the stability of holding. Moreover, a central opening defined by the surrounding wall 21 of the magazine base 2 is larger than an opening of the front space portion (131*d*), so that the user can insert the magazine 4 into the front space portion (131*d*) quickly and accurately.

The connecting portion 213 of this embodiment is hollow, is connected to and extends upwardly, inclinedly and forwardly from an inner wall surface 212 of the surrounding wall 21 in proximity to the rear end portion thereof, and is insertable into the rear space portion (131*e*) through the opening (131*c*). The connecting portion 213 has two pin holes (213*a*) opposite to each other in a left-right direction (D1) transverse to the front-rear direction (D3). In an alternative embodiment, the connecting portion 213 may be a solid structure which has only one pin hole (213*a*) extending therethrough in the left-right direction (D1). After the connecting portion 213 is inserted into the rear space portion (131*e*), the pin holes (213*a*) are respectively aligned with the positioning holes 134 of the handgrip portion 13.

The inner connecting flange 214 protrudes upwardly from the inner wall surface 212 of the surrounding wall 21, and extends from the front end portion to the intermediate portion of the surrounding wall 21. When the magazine base 2 is assembled to the handgrip portion 13, the inner connecting flange 214 is pressfitted into the inner wall surface (131*a*) of the handgrip portion 13.

The snap block 22 is disposed on the front end portion of the surrounding wall 21, and has a neck portion 221 extending upwardly, inclinedly and forwardly from the inner connecting flange 214, and an engaging portion 222 protruding forwardly from a top end of the neck portion 221 and detachably engageable with the snap hole 133. The neck portion 221 has a certain degree of hardness so that it will not move relative to the surrounding wall 21.

The positioning pin 3 is detachably inserted through the positioning holes 134 and the pin holes (213*a*) to fix the magazine base 2 to the handgrip portion 13.

To assemble the magazine base 2 to the handgrip portion 13, the magazine base 2 is first moved close to the opening (131*c*) of the handgrip portion 13 so as to extend the snap block 22 into the front space portion (131*d*) through the opening (131*c*) without being caught by a front edge of the handgrip portion 13, after which the engaging portion 222 of the snap block 22 is engaged with the snap hole 133 from inside of the grip body 131, the connecting portion 213 is inserted into the rear space portion (131*e*), and the inner connecting flange 214 is pressfitted into the inner wall surface (131*a*) of the grip body 131. At this time, the pinholes (213*a*) are aligned with the respective positioning holes 134 of the handgrip portion 13. Finally, the positioning pin 3 is inserted through the positioning holes 134 and the pin holes (213*a*), thereby fixing the magazine base 2 to the handgrip portion 13. The assembly of the magazine base 2 to the handgrip portion 13 is thus completed. It is worth to mention herein that, since an insertion direction of the positioning pin 3 is perpendicular to the direction of a recoil force generated when the pistol device 100 is fired, the positioning pin 3 will not be easily loosened and released from the handgrip portion 13 because of multiple firings of the pistol device 100.

Figure 6:
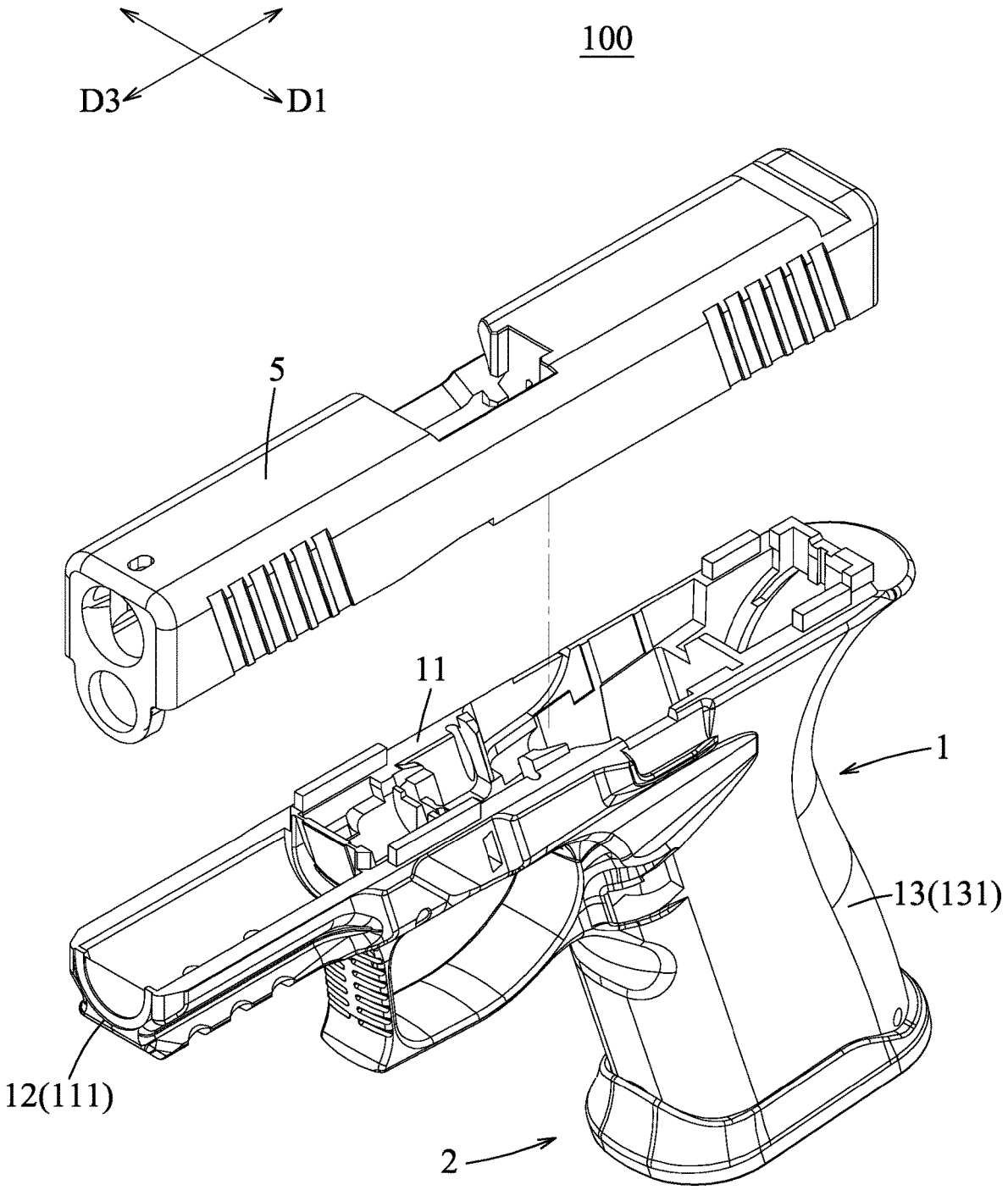
FIG. 6 is a partly exploded perspective view of a pistol device according to the second embodiment of the present disclosure.
Figure 7:
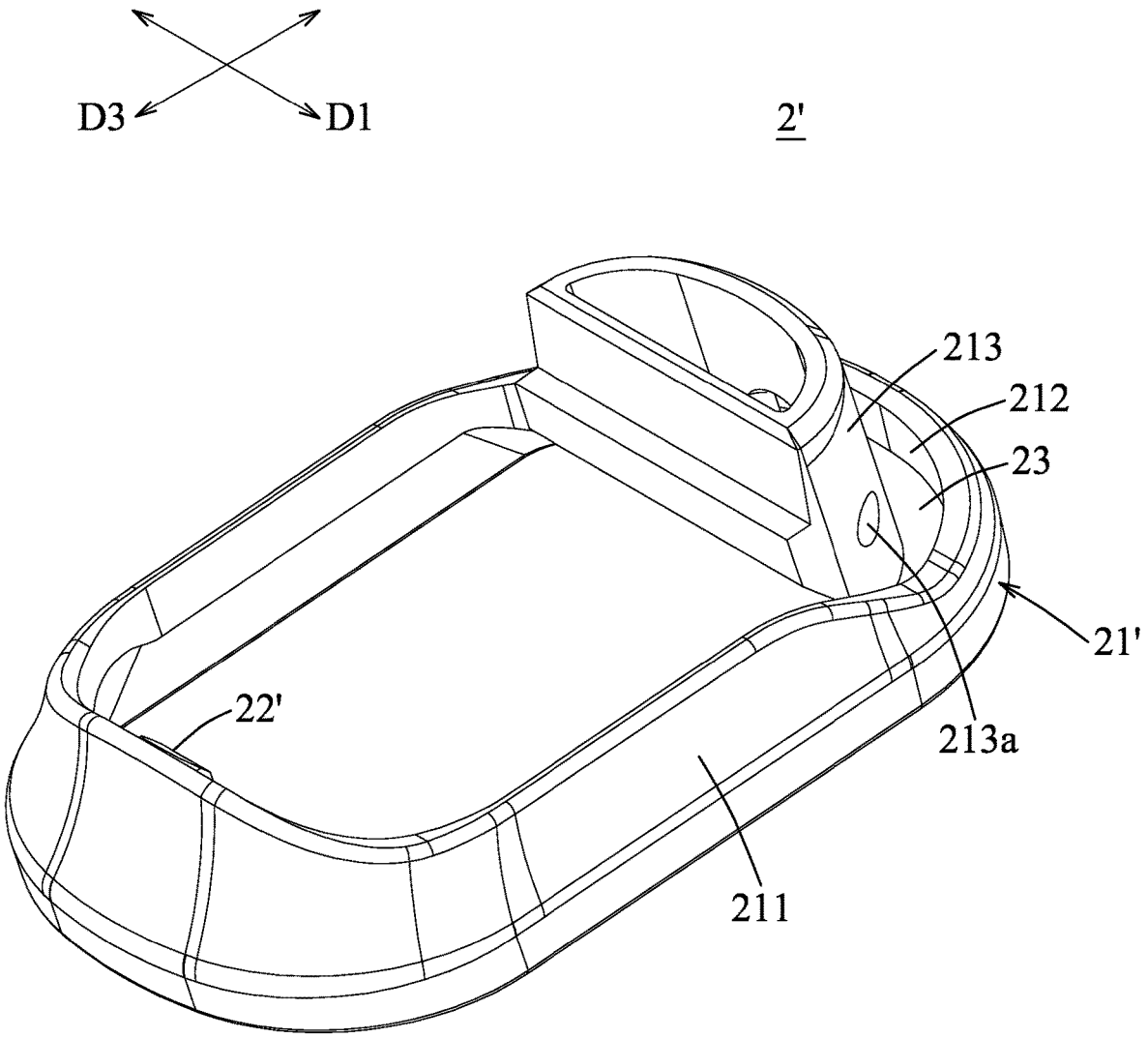
FIG. 7 is a perspective view of a magazine base of the second embodiment.
Figure 8:
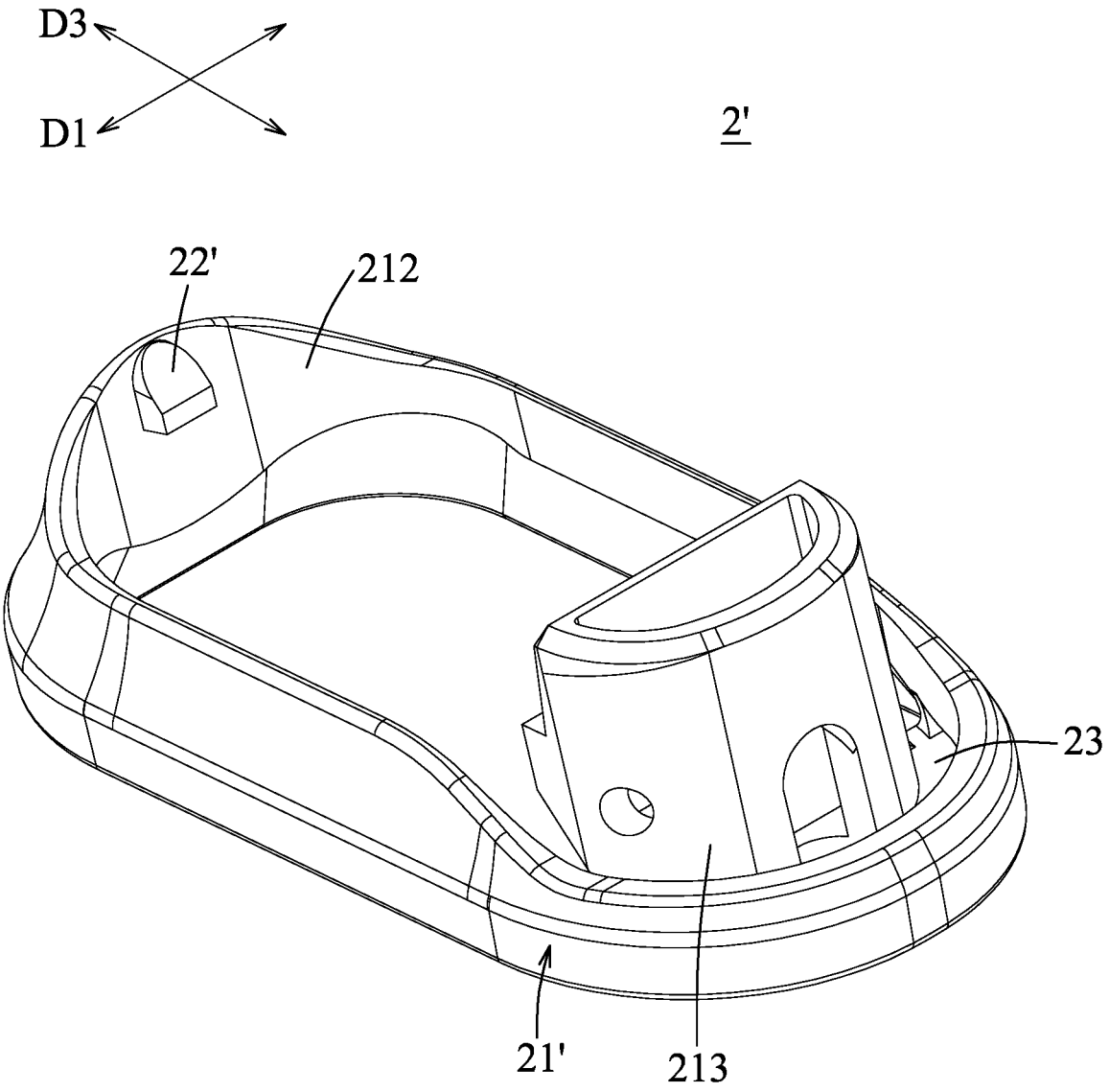
FIG. 8 is a view similar to FIG. 7, but taken from another angle.

Referring to FIGS. 6 to 8, the second embodiment of the pistol device 100 of this disclosure is shown to be identical to the first embodiment. However, in the second embodiment, the inner wall surface 212 of the surrounding wall 21' of the magazine base 2' has a length measured in the front-rear direction (D3) greater than that of the grip body 131, and a width measured in the left-right direction (D1) greater than that of the grip body 131, so that when the magazine base 2' is assembled to the handgrip portion 13, the surrounding wall 21' can surround the bottom end of the handgrip portion 13. Further, a height of the front end portion of the surrounding wall 21' is greater than that of the intermediate portion, and the height of the intermediate portion is greater than that of the rear end portion. A rear seat 23 is connected transversely to the inner wall surface 212 of the surrounding wall 21' in proximity to the rear end portion thereof. The connecting portion 213 extends upwardly, inclinedly and forwardly from the rear seat 23. The snap block 22' is disposed on the inner wall surface 212 of the surrounding wall 21' in proximity to the front end portion thereof. When the magazine base 2' is assembled to the handgrip portion 13, the snap block 22' can engage the snap hole 133 from outside of the grip body 131.

Figure 9:
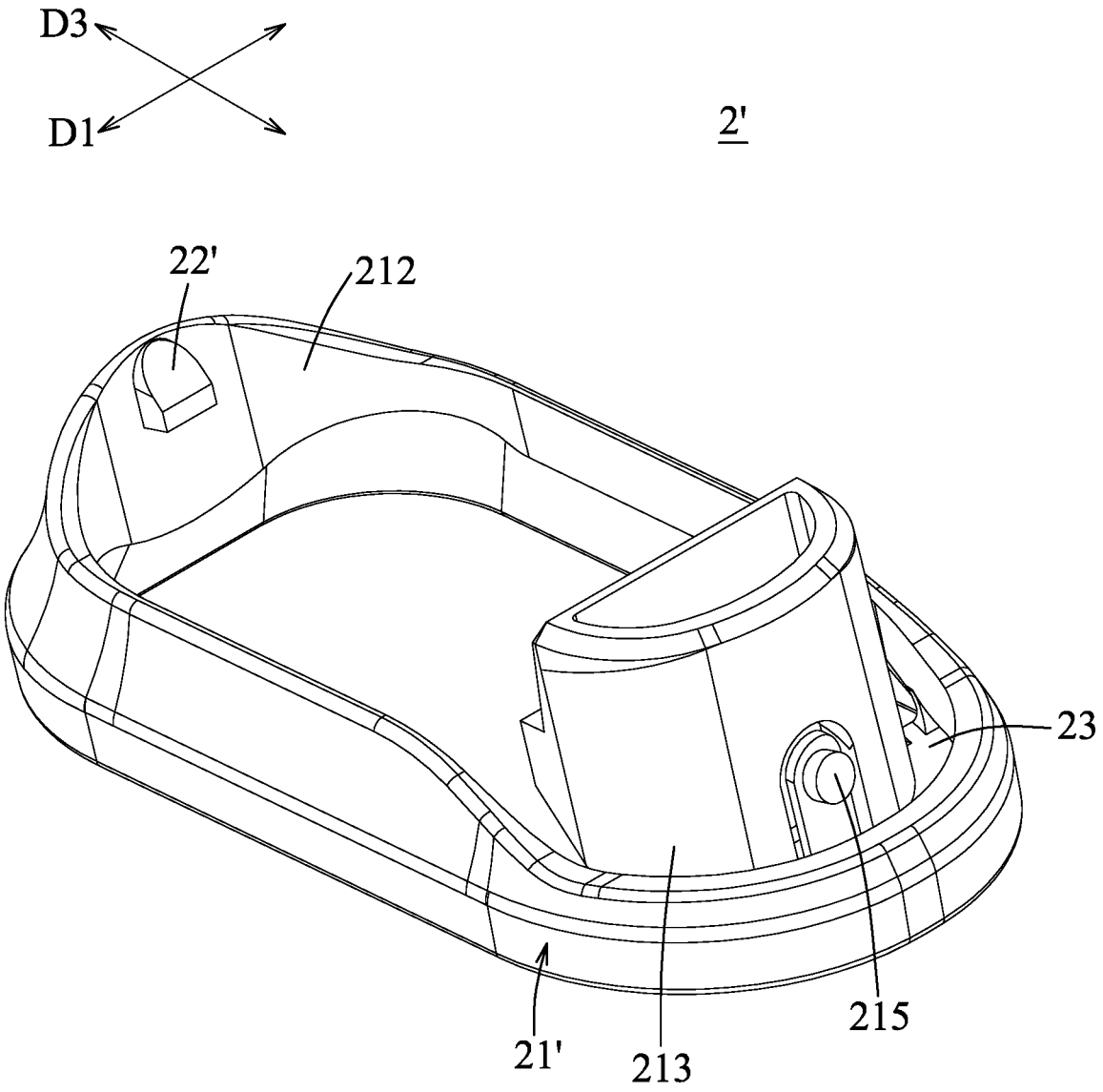
FIG. 9 is an alternative form of the magazine base of the second embodiment.

An alternative form of the magazine base 2' is shown in FIG. 9. In this case, the magazine base 2' further includes an engaging block 215 flexibly disposed on a rear side of the connecting portion 213, and the handgrip portion 13 (see FIG. 6) further has an engaging hole (not shown) located at the rear side of the grip body 131 (see FIG. 6) for engagement with the engaging block 215. The magazine base 2' can be connected to the inner wall surface (131*a*) of the grip body 131 (see FIG. 4) through the snap block 22' at the front side thereof and the engaging block 215 at the rear side thereof, so that it can be positioned to the bottom end of the handgrip portion 13. Further, in this case, the pin holes 213*a* (see FIG. 7) of the connecting portion 213 may be omitted.

Figure 10:
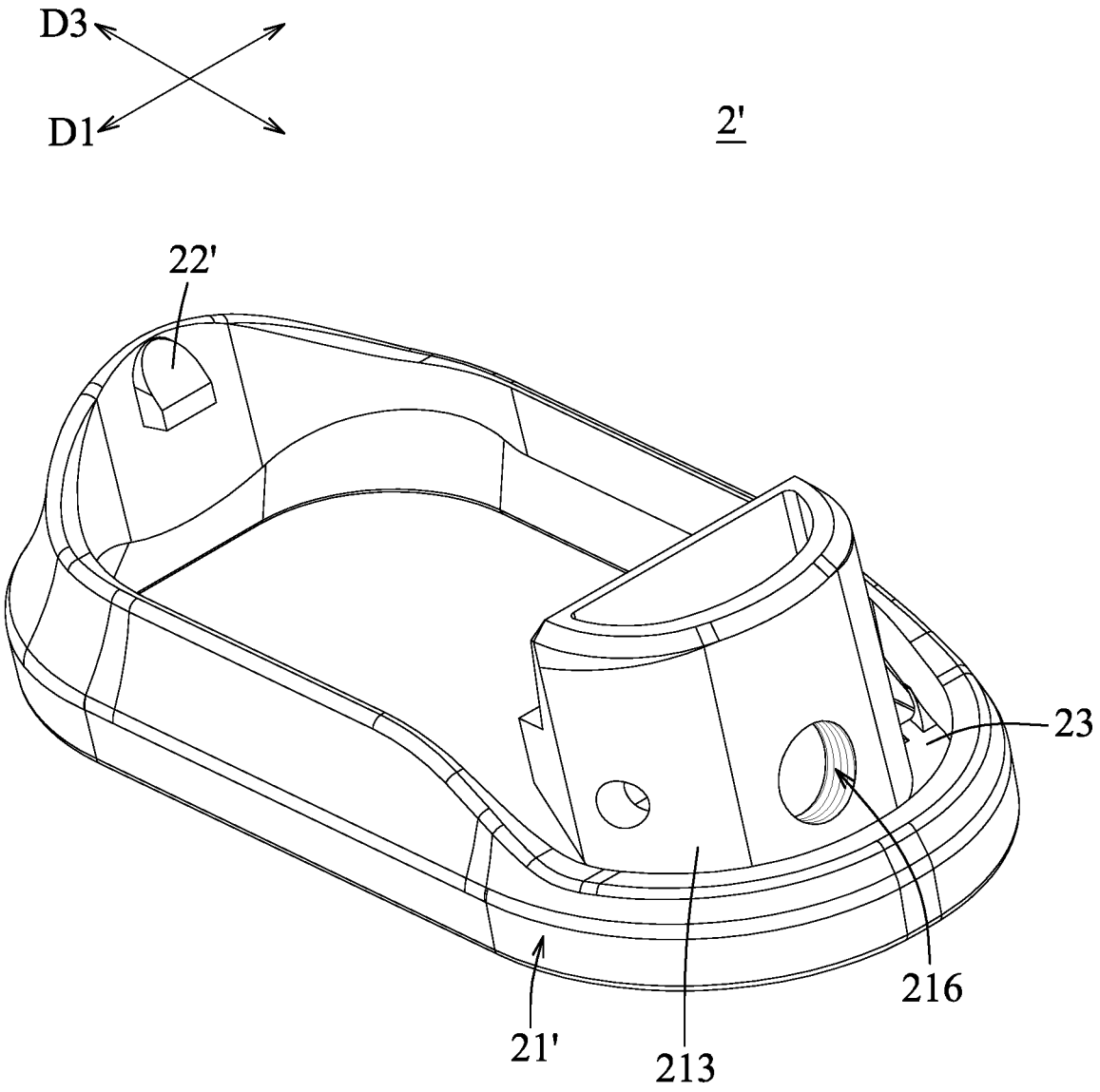
FIG. 10 is another alternative form of the magazine base of the second embodiment.

Another alternative form of the magazine base 2' is shown in FIG. 10. In this case, the magazine base 2' further includes a fastening hole 216 formed in a rear side of the connecting portion 213 and extending in the front-rear direction (D3), and the handgrip portion 13 (see FIG. 6) further has a through hole (not shown) located at the rear side of the grip body 131 (see FIG. 6) for aligning with the fastening hole 216. A screw (not shown) may be inserted through the through hole and threadedly fastened to the fastening hole 216, thereby fixing the magazine base 2' to the handgrip portion 13.

From the aforesaid description, it is apparent that the fixing method of the rear side of the magazine base 2, 2' to the handgrip portion 13 is not limited to using the positioning pin 3, the engaging block 215 or the screw may also be used, or they may be used together to provide users with more fixing options.

In sum, in the pistol device 100 of this disclosure, with the magazine base 2, 2' being designed with the snap block 22, 22' for detachable engagement with the snap hole 133 of the handgrip portion 13, and by using the positioning pin 3 to extend through the positioning holes 134 of the handgrip portion 13 and the pin holes (213*a*) of the magazine base 2, 2', the magazine base 2, 2' can be easily assembled to and disassembled from the handgrip portion 13. Further, apart from fixing the magazine base 2, 2' to the handgrip portion 13, since an insertion direction of the positioning pin 3 is perpendicular to the direction of the recoil force generated when the pistol device 100 is fired, the positioning pin 3 will not be easily loosened and released from the handgrip portion 13. Moreover, the magazine base 2, 2' can adopt customized and modularized design to substantially prolong the length of the handgrip portion 13 so as to increase the capacity of the magazine 4, or to enlarge the opening at the bottom end of the handgrip portion 13, or both of the above. Thus, there is no need for the user to purchase different styles of pistol devices, the magazine base 2, 2' is simply replaced, and the demand can be fulfilled in a short time. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pistol device comprising:

a frame made of plastic and including a handgrip portion which has a grip body defining an accommodation space, a snap hole extending through a front side of said grip body and communicating with said accommodation space, and two positioning holes respectively extending through left and right sides of said grip body in proximity to a rear side thereof and communicating with said accommodation space, said accommodation space having an opening that faces downward, and being configured to accommodate a magazine that extends therein through said opening;

a magazine base detachably disposed on a bottom end of said handgrip portion and including a surrounding wall that has a front end portion, a rear end portion and an intermediate portion between said front and rear end portions, a snap block disposed on said surrounding wall and detachably engageable with said snap hole, and a connecting portion connected to said surrounding wall in proximity to said rear end portion and having at least one pin hole that extends therethrough in a left-right direction and that aligns with said positioning holes; and a positioning pin detachably inserted through said positioning holes and said at least one pin hole to fix said magazine base to said handgrip portion.

2. The pistol device as claimed in claim 1, wherein said handgrip portion further has a partition plate dividing said accommodation space into a front space portion and a rear space portion, said front space portion being configured to receive the magazine, said connecting portion being insertable into said rear space portion through said opening.

3. The pistol device as claimed in claim 2, wherein said magazine base further includes an inner connecting flange protruding upwardly from an inner wall surface of said surrounding wall and extending from said front end portion to said intermediate portion of said surrounding wall, said snap block being disposed on said front end portion of said surrounding wall, and having a neck portion extending upwardly, inclinedly and forwardly from said inner connecting flange, and an engaging portion protruding forwardly from a top end of said neck portion and detachably engaging said snap hole from inside of said grip body.

4. The pistol device as claimed in claim 3, wherein said grip body has an inner wall surface defining said accommodation space, said inner connecting flange being press-fitted into said inner wall surface.

5. The pistol device as claimed in claim 2, wherein said surrounding wall has an inner wall surface with a length measured in a front-rear direction, which is transverse to the left-right direction, greater than that of said grip body, and a width measured in the left-right direction greater than that of said grip body, said snap block being disposed on said inner wall surface of said surrounding wall in proximity to said front end portion thereof and being engaged with said snap hole from outside of said grip body.

6. The pistol device as claimed in claim 1, wherein said magazine base further includes an engaging block flexibly disposed on a rear side of said connecting portion for engagement with said grip body.

7. The pistol device as claimed in claim 1, wherein said magazine base further includes an engaging block flexibly disposed on a rear side of said connecting portion for engagement with said grip body.

8. The pistol device as claimed in claim 1, wherein said magazine base further includes a fastening hole formed in a rear side of said connecting portion and extending in a front-rear direction, which is transverse to the left-right direction, for engagement with said grip body.

9. The pistol device as claimed in claim 1, wherein said frame further includes an upper frame portion that extends along a front-rear direction transverse to the left-right direction, that is connected to said handgrip portion and that has an end opening distal to said handgrip portion, and a removable plate portion removably disposed on said end opening, said removable plate portion including a semi-circular U-shaped outer plate portion connected to said upper frame portion, and a semi-circular inner plate portion connected to said semi-circular U-shaped outer plate portion.

* * * * *